US008408304B2

(12) United States Patent
Hummes et al.

(10) Patent No.: US 8,408,304 B2
(45) Date of Patent: Apr. 2, 2013

(54) PUMP MECHANISM FOR COOLING OF ROTARY BEARINGS IN DRILLING TOOLS AND METHOD OF USE THEREOF

(75) Inventors: Olof Hummes, Kingwood, TX (US); Bernd Santelmann, Boehme (DE); Sven Kruger, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 174 days.

(21) Appl. No.: 12/411,173

(22) Filed: Mar. 25, 2009

(65) Prior Publication Data

US 2009/0242276 A1 Oct. 1, 2009

Related U.S. Application Data

(60) Provisional application No. 61/040,447, filed on Mar. 28, 2008.

(51) Int. Cl.
*E21B 36/00* (2006.01)
*E21B 7/00* (2006.01)
*E21B 17/18* (2006.01)

(52) U.S. Cl. ..... 166/302; 166/54.1; 166/68.5; 175/424

(58) Field of Classification Search ..... 384/313, 384/97, 92, 93; 166/302, 54.1, 68.5; 175/424
See application file for complete search history.

(56) References Cited

U.S. PATENT DOCUMENTS

| | | | | |
|---|---|---|---|---|
| 4,668,168 | A | 5/1987 | Schilder et al. | |
| 5,054,583 | A | 10/1991 | Wrzyszczynski | |
| 5,141,422 | A | 8/1992 | Ito et al. | |
| 5,209,577 | A * | 5/1993 | Swatek | 384/97 |
| 5,368,110 | A | 11/1994 | French | |
| 5,782,302 | A * | 7/1998 | Ringgenberg et al. | 166/305.1 |
| 5,813,469 | A * | 9/1998 | Bowlin | 166/369 |
| 6,093,001 | A | 7/2000 | Burgreen et al. | |
| 6,099,271 | A | 8/2000 | Brookbank | |
| 6,109,790 | A * | 8/2000 | von Gynz-Rekowski et al. | 384/97 |
| 6,439,325 | B1 | 8/2002 | Peters et al. | |
| 6,439,866 | B1 | 8/2002 | Farkas et al. | |
| 6,837,621 | B1 * | 1/2005 | Sakamoto | 384/97 |
| 7,492,069 | B2 | 2/2009 | Knox et al. | |
| 7,621,346 | B1 | 11/2009 | Trinh et al. | |
| 7,841,395 | B2 * | 11/2010 | Gay et al. | 166/105 |

* cited by examiner

*Primary Examiner* — Cathleen Hutchins
(74) *Attorney, Agent, or Firm* — Mossman, Kumar & Tyler, PC

(57) ABSTRACT

A bearing for a wellbore tool includes a flow device. The flow device may be a pump such as a positive displacement pump or a hydrodynamic pump. In arrangements, a pump stator connects to a wellbore wall. A pump rotor rotates with a drilling motor, and/or a drill string. Rotation of the pump rotor may generate a pressure differential to displace the fluid. The pump may be configured to flow fluid across a gap between a rotating section and a non-rotating section of the bearing. The fluid may be drawn from a wellbore annulus and also returned into the wellbore annulus. The bearing may support thrust loadings and/or a radial loadings. In embodiments, inserts in the bearing may be used to filter the fluid.

17 Claims, 5 Drawing Sheets

PUMP MECHANISM FOR COOLING OF ROTARY BEARINGS IN DRILLING TOOLS AND METHOD OF USE THEREOF

CROSS-REFERENCE TO RELATED APPLICATIONS

This application takes priority from the U.S. Provisional Patent Application Ser. No. 61/040,447, filed Mar. 28, 2008.

BACKGROUND OF THE DISCLOSURE

1. Field of the Disclosure

This disclosure relates generally to oilfield downhole tools and more particularly to methods and devices for cooling of bearings in drilling tools.

2. Description of the Related Art

To obtain hydrocarbons such as oil and gas, boreholes or wellbores are drilled by rotating a drill bit attached to the bottom of a BHA (also referred to herein as a "Bottom Hole Assembly" or ("BHA"). The BHA is attached to the bottom of a tubing, which is usually either a jointed rigid pipe or a relatively flexible spoolable tubing commonly referred to in the art as "coiled tubing." The string comprising the tubing and the BHA is usually referred to as the "drill string." When jointed pipe is utilized as the tubing, the drill bit is rotated by rotating the jointed pipe from the surface and/or by a mud motor contained in the BHA. In the case of a coiled tubing, the drill bit is rotated by the mud motor. During drilling, a drilling fluid (also referred to as the "mud") is supplied under pressure into the tubing. A rotor of the mud motor is rotated by the drilling fluid passing through the BHA. A drive shaft connected to the motor and the drill bit rotates the drill bit. Some drill strings include steering devices that may utilize devices that have a rotating section and a non-rotating section.

The non-rotating section remains mostly stationary relative to the wellbore as the drill string rotates. The present disclosure addresses the need for effective cooling and/or lubrication of the interfaces between the rotating and non-rotating sections of such steering devices as well as other interfaces between rotating and non-rotating components along a drill string.

SUMMARY OF THE DISCLOSURE

In aspects, the present disclosure provides a method for supplying fluid to a wellbore tool having a bearing. In one embodiment, the method includes flowing a fluid into the bearing; and adding energy to the fluid. In one arrangement, the energy is added by operating a pump. The method may include connecting a stator of the pump to a wall of a wellbore. Also, the method may include rotating a rotor of the pump with one of: (i) a drilling motor, and (ii) a drill string. In aspects, the method may include generating a pressure differential in the fluid by operating the pump. In further aspects, the method may include filtering the fluid using inserts disposed in the bearing. In embodiments, the method may utilize drawing the fluid from an annulus formed between a drill string and a wellbore wall. The method may also utilize ejecting the fluid into the annulus.

In aspects, the present disclosure provides a wellbore apparatus that may include a drill string; a bearing positioned along the drill string; and a flow device positioned on the drill string. The bearing may have a rotating section connected to the drill string and a non-rotating section. A gap may separate the rotating section from the non-rotating section. The flow device may flow a fluid through the gap, which may include an annular portion. In one arrangement, the flow device may include a stator portion fixed to the non-rotating section of the bearing and a rotor portion connected to the rotating section of the bearing. In aspects, the flow device may be formed in the bearing. In one arrangement, the bearing may include opposing ends, each end having a radially outward bearing surface and a radially inward bearing surface. The flow device may be positioned between the opposing ends. In further embodiments, the apparatus may include inserts disposed either or both of on the radially inward bearing surface and the radially outward bearing surface. In configurations, the formation of defined gaps in between the inserts may allow passage of (i) fluid and (ii) particles of a defined size. In aspects, the flow device may be a pump. In one embodiment, the pump may be a positive displacement pump. In other embodiments, the pump may be a hydrodynamic pump. In aspects, the bearing may be configured to bear a thrust loading and/or a radial load.

In aspects, the present disclosure further provides a system for use in a wellbore, the system including a rig disposed over the wellbore; a drill string conveyable into the wellbore using the rig; a bearing positioned along the drill string, the bearing having a rotating section connected to the drill string and a non-rotating section. A gap may separate the rotating section from the non-rotating section; and a flow device positioned on the drill string may flow a fluid through the gap.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to devices and methods for cooling and/or lubricating an interface between an rotating element and a non-rotating element along a wellbore tubular such as a drill string. The present disclosure is susceptible to embodiments of different forms. The drawings show and the written specification describes specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Figure 1:
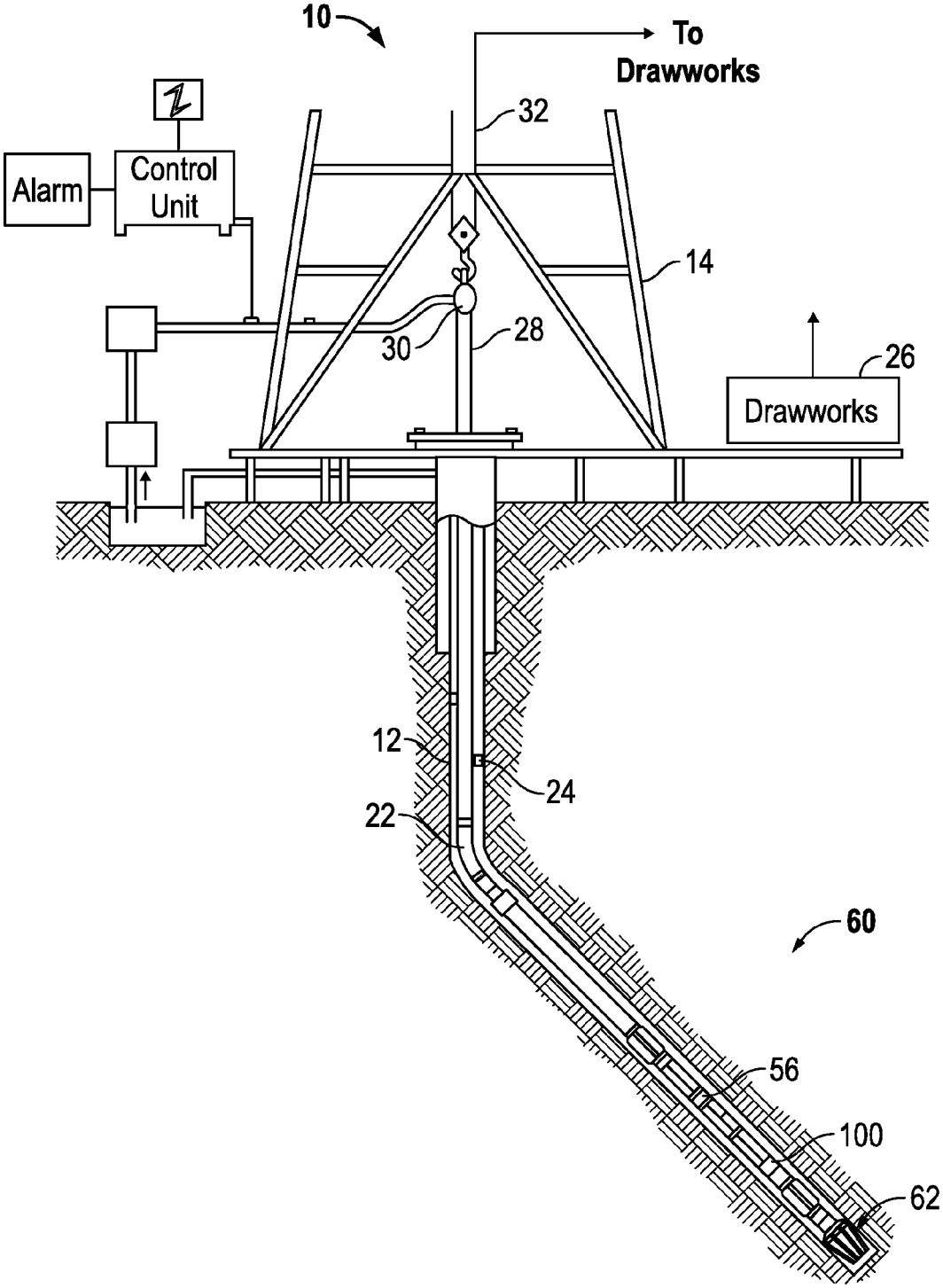
FIG. 1 illustrates a drilling system made in accordance with one embodiment of the present disclosure.

Referring now to FIG. 1, there is shown an embodiment of a drilling system 10 utilizing a bottomhole assembly (BHA) 60 configured for drilling wellbores. As will be appreciated from the discussion below, the cooling/lubrication devices and methodologies according to the present disclosure may provide forced mud flow across an interface separating a rotating element and a non-rotating element. The term "forced" is meant as mud flow in addition to the mud flow, if any, that would occur due to a pressure differential attributable to ambient wellbore conditions, the operation of surface equipment, etc.

In one embodiment, the system 10 shown in FIG. 1 includes a bottomhole assembly (BHA) 60 conveyed in a borehole 12 as part of a drill string 22. The drill string 22 includes a tubular string, which may be drill pipe or coiled tubing, extending downward into the borehole 12 from a rig 14. The drill bit 62, attached to the drill string end, disintegrates the geological formations when it is rotated to drill the borehole 12. The drill string 22, which may be jointed tubulars or coiled tubing, may include power and/or data conductors such as wires for providing bi-directional communication and power transmission. For purposes of this disclosure, the drill string 22 includes all elements from the surface and down to and including the drill bit 62. The drill string 22 is coupled to a drawworks 26 via a kelly joint 28, swivel 30 and line 32. The operation of the drawworks 26 is well known in the art and is thus not described in detail herein. It should be understood that the FIG. 1 drilling system is merely one of many types of drilling systems that may be utilized in connection with the present disclosure. For example, top drive systems, which replace the kelly 28, and utilize hydraulic powered or electric motors to rotate the drill string may also be used. While a land-based rig is shown, these concepts and the methods are equally applicable to offshore drilling systems. A communication system for transmitting uplinks and downlinks may include mud-driven power generation units (mud pursers), or other suitable two-way communication systems that use hard wires (e.g., electrical conductors, fiber optics), acoustic signals, EM or RF.

The BHA 60 may include a formation evaluation sub 56 that may include sensors for determining parameters of interest relating to the formation, borehole, geophysical characteristics, borehole fluids, directional survey information and boundary conditions. These sensors include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid.

Figure 2:
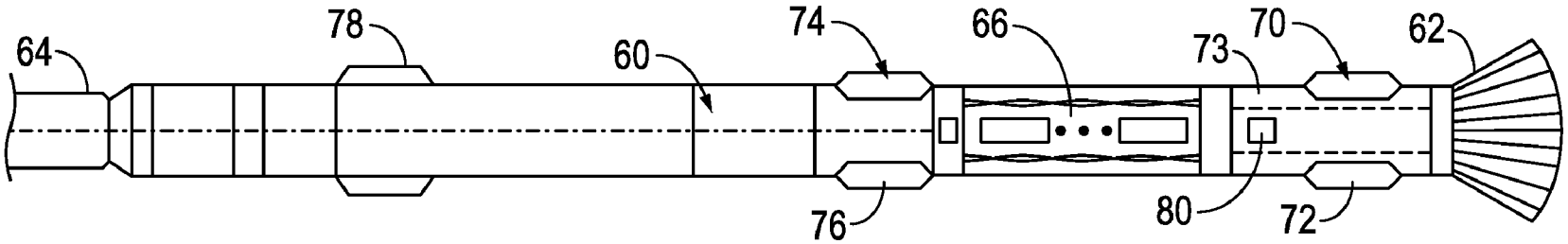
FIG. 2 illustrates in schematic format a BHA having tools incorporating a non-rotating section in accordance with one embodiment of the present disclosure.

Referring now to FIG. 2, there is shown in greater detail certain elements of the BHA 60. The BHA 60 carries the drill bit 62 at its bottom or the downhole end for drilling the wellbore and is attached to a drill pipe 64 at its uphole or top end. A mud motor or drilling motor 66 above or uphole of the drill bit 62 may be a positive displacement motor. A turbine may also be used. Fluid supplied under pressure via the drill pipe 64 energizes the motor 66, which rotates the drill bit 62. The fluid returns via an annulus 24 (FIG. 1) formed between the drill string 22 (FIG. 1) and a wall of the wellbore 12 (FIG. 1). It should be understood that the drilling motor 66 is an optional device that may be omitted from certain BHA configurations.

The BHA 60 also includes a first steering device 70 that contains one or more expandable ribs 72 that may in certain embodiments be independently controlled to exert a desired force on the wellbore wall to steer the drill bit 62 during drilling of the borehole. In other embodiments, a common control for the ribs 72 may be employed. The rib 72 can be adjusted to any position between a collapsed position and a fully extended position to apply the desired force vector to the wellbore wall. The ribs 72 are positioned on a non-rotating sleeve 73. The non-rotating sleeve 73 may be integrated with a bearing of the mud motor 66 or may be positioned on a separate section of the BHA 60. In either case, the non-rotating sleeve 73 surrounds an element that rotates during drilling. When the ribs 72 are extended into engagement with the wellbore wall, the non-rotating sleeve 73 is locked with the wellbore wall and does not rotate with the drill string, or rotates very little. Thus, there is sliding contact and friction between an interior surface of the non-rotating sleeve 73 and the bearing surfaces of the rotating shaft or mandrel (not shown).

A second steering device 74 may disposed a suitable distance uphole of the first steering device 70. The steering device 74 also includes a plurality of independently controlled ribs 76. One or more stabilizers 78 may be disposed uphole of the second steering device 74. The stabilizer 78 may be fixed diameter stabilizers or may also include adjustable ribs. Moreover, the stabilizer 78 may utilize a non-rotating sleeve as described previously. In the BHA configuration 60, the drill bit 62 may be rotated by the drilling motor 66 and/or by rotating the drill pipe 64. Thus, the drill pipe rotation may be superimposed on the drilling motor rotation for rotating the drill bit 62.

The steering devices 70 and 74, as well as the stabilizer 78, are illustrative of tools and devices in the BHA 60 that have an interface between a rotating component and a non-rotating component. These interfaces typically have contact between the surfaces of the rotating and non-rotating elements and therefore require some form of cooling and lubrication to ensure that these components function properly and do not fail prematurely. Thus, embodiments of the present disclosure provide forced or directed flow of fluids across these interfaces. Illustrative arrangements are discussed below.

Figure 3:
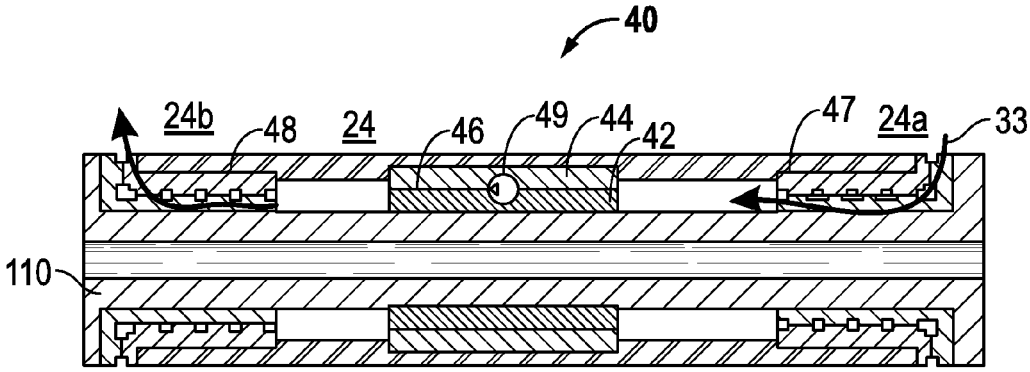
FIG. 3 schematically illustrates an active flow device for supplying fluid to a bearing in accordance with one embodiment of the present disclosure.

Referring now to FIG. 3, there is shown a bearing 40 of a tool along the BHA 60 (FIG. 2), such as the steering devices 70 and 74 and/or the stabilizer 78 (FIG. 2). The bearing 40 may include an inner section 42 and an outer section 44. An annular gap 46 separates the inner section 42 from the outer section 44. The gap 46 has fluid communication with the fluid in the annulus 24. In embodiments, the bearing 40 includes a first and second bearing unit 47 and 48 formed at the ends of the bearing 40 and an active flow device 49 positioned between the first and second bearing units 47 and 48. As used herein, an active flow device 49 is a device that adds energy to a fluid 33 to cause flow of the fluid 33 in a desired direction through the gap 46. For instance, the fluid 33 enters from one section 24*a* of the annulus 24 and flows along the gap 46 to cool and lubricate the interfaces between the rotating and non-rotating surfaces of the bearing units 47 and 48. The fluid 33 is then ejected into another section 24*b* of the annulus 24. In embodiments, the active flow device 49 may be positioned in a substantially sealed enclosure.

The active flow device 49 may be configured as any number of devices that use either the rotating drill string or other source to add energy to the fluid in the gap 46. One suitable flow device may include gear pumps, which are described in connection with FIGS. 6A and 6B. Other suitable, active flow devices may utilize radially or axially articulated pistons and associated valves. Such devices may use valves designed with a large open cross-section and rubber elements as sealing members. Still other embodiments may utilize radially or axially articulated membranes and associated valves or peristaltic pump arrangements. Further, turbines or labyrinth arrangements may be utilized where relative motion speed is sufficient to create hydrodynamic pressure. Additionally, electric, magnetic, or mechanical coupling, with or without the use of gears to increase or decrease the pump speed, may be utilized to drive a pump. The type of coupling may utilize the relative motion between shaft and sleeve to actuate a pump component or pressurize fluids; e.g., hydraulic actuators In still further embodiments, the active flow device may operate independently from the relative motion between the rotating drill string and the bearing. Such devices may utilize pumps having electric motors, hydraulically driven motors, etc. The power for such pumps may be supplied from a downhole power source and/or a surface source.

Illustrative embodiments of active flow devices used in connection with bearings for downhole uses are described below.

Figure 4A:
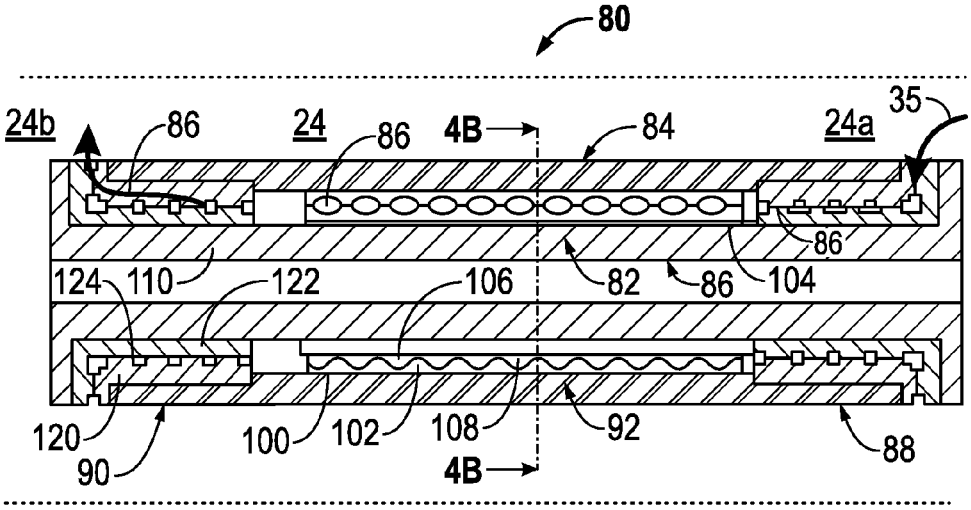
FIG. 4A schematically illustrates a positive displacement pump for supplying fluid to a bearing in accordance with one embodiment of the present disclosure.
Figure 4B:
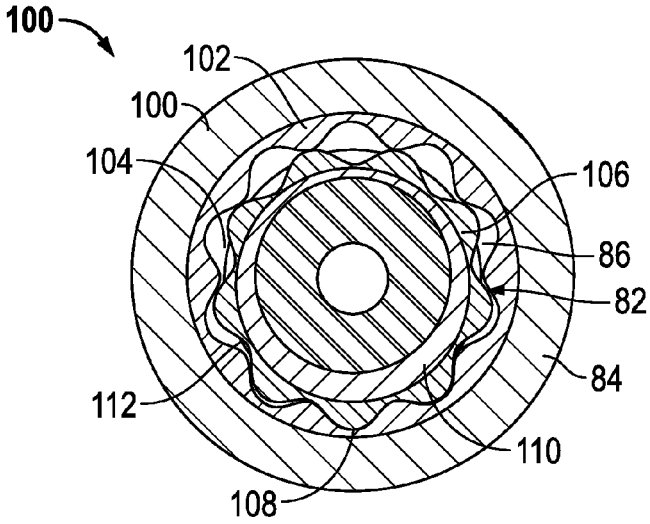
FIG. 4B sectionally illustrates the FIG. 4A embodiment.

Referring now to FIGS. 4A and 4B, there is shown a bearing 80 that utilizes a positive displacement pump for an active flow device. In FIGS. 4A and 4B, a bearing 80 of a tool along the BHA 60 (FIG. 2), such as the steering devices 70 and 74 and/or the stabilizer 78 (FIG. 2) may include an inner section 82 and an outer section 84. An annular gap 86 separates the inner section 82 from the outer section 84. The gap 86 has fluid communication with the fluid in the annulus 24. In embodiments, the bearing 80 includes a first and second bearing unit 88 and 90 formed at the ends of the bearing 80 and a positive displacement pump 92 positioned between the first and second bearing units 88 and 90. The pump 92 adds energy to a fluid 35 to cause flow of the fluid 35 in a desired direction through the gap 86. For instance, the fluid 35 enters from one section 24*a* of the annulus 24 and flows along the gap 86 to cool and lubricate the interfaces between the rotating and non-rotating surfaces of the bearing units 88 and 90. The fluid 35 is then ejected into another section 24*b* of the annulus 24.

In one embodiment, the flow device 92 may include a stator 100 formed in the outer section 84. The stator 100 may include a radially inner surface on which are formed lobes 102. The flow device 92 may also include a rotor assembly 104 formed in the inner section 82. The rotor assembly 104 may include a tubular lobe section 106 having radially outwardly projecting lobes 108. The rotor assembly may also include an eccentric ring 110 that surrounds a drive shaft 112. The drive shaft 112 may be connected to an output of the drilling motor 66 (FIG. 2) or to the drill pipe 64 (FIG. 2). The lobes 102 of the stator 100 and the lobes 108 of the rotor assembly 104 cooperate to move fluid by trapping a fixed amount of fluid between the lobes 106, 108 and then forcing that trapped volume of fluid axially along the flow device 92. For example, when the outer section 84 is held stationary and the inner section 82 is rotated, the rotor assembly 104 rotates relative to the stator 100. The eccentric ring 110 causes the tubular lobe section 106 to rotate eccentrically within the stator 100. Thus, in a predetermined pattern or motion the lobes 106 of the stator 100 and the lobes 108 create pockets or volumes of fluid and push that fluid across the flow device 92. Thus, for instance, fluid from the first bearing unit 88 may be conveyed to the second bearing unit 90. Thus, in this arrangement, some of the energy associated with the rotary motion of the inner section 82 is added to the fluid to generate fluid flow.

In embodiments, the first and second bearing units 88 and 90 may utilize journal assemblies having diamond inserts. For example, the bearing unit 88 may include an outer bearing ring 120 and an inner bearing ring 122. The outer bearing ring 120 may be composed of an annular, sintered tungsten carbide support element and a series of composite polycrystalline diamond (PCD) inserts 124. The PCD inserts 124 may be circumferentially arrayed on the surfaces of the inner ring 120 and/or the outer ring 122. The spacing of the PCD inserts 124 may be such that debris or other particles may be prevented from entering the flow device 92. That is, the PCD inserts 124 may function as a filtering element that prevents particles from clogging or blocking the gap 86 or other parts of the flow device 92.

Referring now to FIGS. 2, 4A and 4B, in an exemplary mode of operation, the BHA 60 drills a wellbore in a selected direction using the first steering device 70. The ribs 72 are extended as needed to apply side forces against the wellbore wall to steer the drill bit 62. When the ribs 72 engage the wellbore wall, the non-rotating sleeve 73 on which they are positioned stops rotating relative to the wellbore wall. Thus, the inner section 82 of the bearing 80 rotates relative to the outer section 84. This relative rotation causes the lobes 102 of the stator 100 and the lobes 108 of the rotor assembly 104 to trap and convey a fixed amount of fluid axially along the flow device 92. For instance, fluid from the annulus section 24*a* is drawn into the first bearing unit 88, displaced across the flow device 92, pushed through the second bearing unit 90, and ejected into the annulus section 24*b*. In this manner, a forced fluid flow is established across the flow device 92, which causes fluid flow through the bearing units 88 and 90 and may cool and lubricate the bearing units 88 and 90.

It should be appreciated that the pump 92 may generate the flow across the bearing 80 without need for an existing pressure differential between the first bearing section 88 and the second bearing section 90. It should also be appreciated that the pump 92 provides a controlled flow of fluid, e.g., a flow rate, that may be substantially independent from surface mud pump operating set points such as flow rate and pressure and generally insensitive to materials such as lost circulation material (LCM) that may be in the fluid.

It should be understood that the teachings of the present disclosure may be applied to any wellbore tool wherein a section of that tool does not rotate relative to a wall of the wellbore; i.e., the tool has a rotating and a non-rotating section. Referring now to FIG. 2, it has been previously described that the stabilizers 78 may include adjustable ribs and/or utilize a non-rotating sleeve. That is, the stabilizer 78 may include one or more independently controllable ribs, such as those described in reference to ribs 76 for the steering device 74. In embodiments, a stabilizer 78 having a rotating and a non-rotating section may be used to position a tool, e.g., an NMR tool, at a pre-determined position in the wellbore. For instance, the sensor may be positioned concentric in the wellbore or eccentric in the wellbore. In other embodiments, the stabilizer 78 may be used as a platform or base for a formation sampling tool. For instance, the stabilizer 78 may include probes that extend radially outward to engage the wall of the wellbore. The probes may be used to retrieve samples of formation fluid. In these and other application, the flow device as described above may be utilized to furnish a flow of fluid across the bearings in the stabilizer 78 as also described above.

Figure 5:
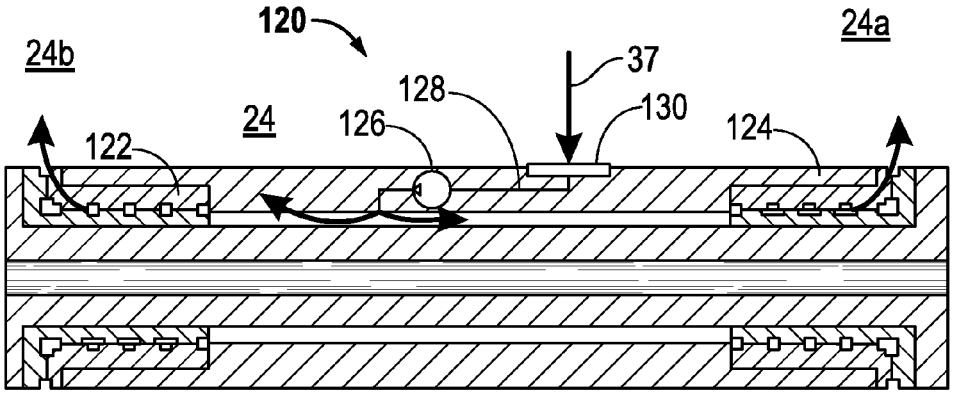
FIG. 5 schematically illustrates an active flow device in accordance with one embodiment of the present disclosure that receives fluid from a filtered flow line and pumps the fluid axially outwardly to the bearing ends.

Referring now to FIG. 5, there is shown another exemplary embodiment of a device for supplying fluid to a bearing in accordance with the present disclosure. In FIG. 5, a bearing 120 includes a first and second bearing unit 122 and 124 formed at the ends of the bearing 120 and an active flow device 126 positioned between the first and second bearing units 122 and 124. The active flow device 126 may be any of the devices described in this disclosure. In a variant to the previously described flow regimes, the active flow device 126 receives fluid from the annulus 24 via a line 128 that includes a filter element 130. The filter element 130 and the line 128 draw a fluid 37 from the region of the annulus 24 between the first and the second bearing units 122 and 124. The fluid 37 enters through the filter element 130, which prevents particles of a predetermined size from entering the flow line 128, and is pumped by the active flow device 126 axially outward to both bearing units 122 and 124. The fluid 37 is then ejected into the sections 24*a* and 24*b* of the annulus 24. In this embodiment, therefore, the fluid 37 is supplied from inside the bearing 120 and exits from both of the bearing units 122 and 124.

Figure 6A:
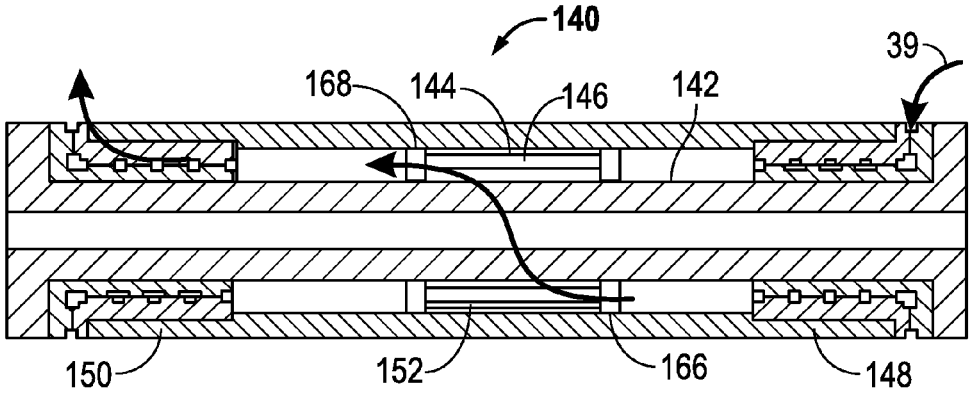
FIG. 6A schematically illustrates a gear pump for supplying fluid to a bearing in accordance with one embodiment of the present disclosure.
Figure 6B:
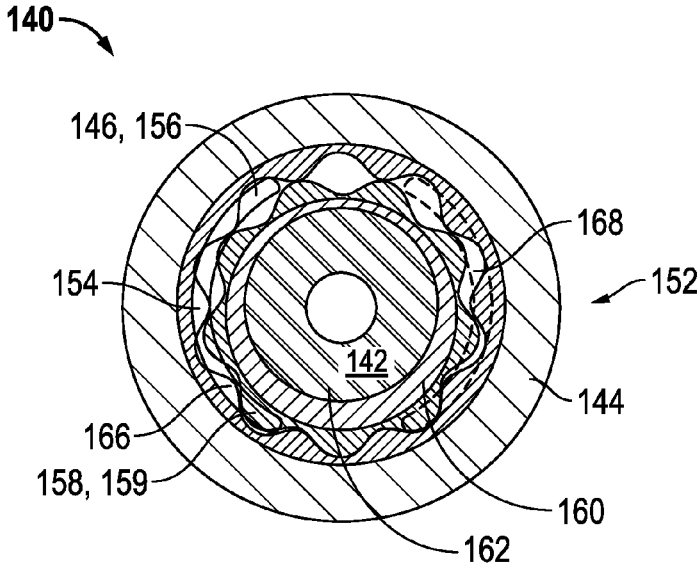
FIG. 6B sectionally illustrates the FIG. 6A embodiment.

Referring now to FIGS. 6A and 6B, there is shown a bearing 140 that utilizes a gear pump for an active flow device. In a manner previously described, the bearing 140 may include an inner section 142 and an outer section 144. An annular gap 146 separates the inner section 142 from the outer section 144. The bearing 140 includes a first and second bearing unit 148 and 150 formed at the ends of the bearing 140. A gear pump 152 is positioned between the first and second bearing units 148 and 140. In one embodiment, the gear pump 152 may include a stator 154 formed in the outer section 144. The stator 154 may include a radially inner surface on which are formed prismatic cavities 156. The gear pump 152 may also include a rotor assembly 158 formed in the inner section 142. The rotor assembly 158 may include a tubular radially outwardly projections 159 that are complementary to or closely mesh with the prismatic cavities 156. The rotor assembly may also include an eccentric ring 160 that surrounds a drive shaft 162 to cause eccentric rotation between the stator 154 and the rotor 158. Additionally, an inlet valve 166 may be positioned at the fluid supply side of the gear pump 152 and an outlet valve 168 may be positioned at the discharge side of the gear pump 152. The inlet and outlet valves 166 and 168 may be configured as disc valves or other suitable one-way valves. The drive shaft 162 may be connected to an output of the drilling motor 66 (FIG. 2) or to the drill pipe 64 (FIG. 2). The projections 156 of the stator 154 and the rotor assembly 158 cooperate to move a fluid 39 by trapping a fixed amount of the fluid 39 between the projections 156 and the projections 159 of the rotor assembly 158, and then forcing that trapped volume of the fluid 39 axially along the flow device 92. The valves 166 and 168 cooperate to prevent backflow of the fluid 39 and to, therefore, ensure uni-directional flow of the fluid 39 across the gear pump 152.

It should be understood that while a journal bearing arrangement has been described above, the present disclosure may also be utilized in connection with other types of bearings, such as thrust bearings. In arrangements utilizing thrust bearings, the gap may be the axially-aligned space between two surfaces.

From the above, it should be appreciated that what has been disclosed includes a method for supplying fluid to a wellbore tool having a bearing. The method may include flowing a fluid into the bearing; and adding energy to the fluid. The energy may be added by operating a pump. A stator of the pump may be connected to a wall of a wellbore. A rotor of the pump may be rotated using a drilling motor, and/or a drill string. In aspects, the method may include generating a pressure differential in the fluid by operating the pump. Also, the method may include filtering the fluid using inserts disposed in the bearing. The method may include drawing the fluid from an annulus formed between a drill string and a wellbore wall and/or ejecting the fluid into the annulus.

From the above, it should also be appreciated that what has been disclosed includes a wellbore apparatus that may include a drill string; a bearing positioned along the drill string; and a flow device positioned on the drill string. The bearing may have a rotating section connected to the drill string and a non-rotating section that are separated by a gap. The flow device may flow a fluid through the gap, which may include an annular portion. In one arrangement, the flow device may include a stator portion fixed to the non-rotating section of the bearing and a rotor portion connected to the rotating section of the bearing. In aspects, the flow device may be formed within the bearing. In one arrangement, the bearing may include opposing ends. Each end may have a radially outward bearing surface and a mating radially inward bearing surface. The flow device may be positioned between the opposing ends. In further embodiments, the apparatus may include inserts disposed either or both of on the radially inward bearing surface and the radially outward bearing surface. In configurations, the gaps between the inserts may be sized to allow passage of (i) fluid and (ii) particles smaller than a defined size. In aspects, the flow device may be a pump. In one embodiment, the pump may be a positive displacement pump. In other embodiments, the pump may be a hydrodynamic pump. In aspects, the bearing may be configured to bear a thrust loading and/or a radial load. It should be appreciated that the such an embodiment may be deployed in connection with a system for use in a wellbore, the system including a rig disposed over the wellbore; a drill string conveyable into the wellbore using the rig; a bearing positioned along the drill string, the bearing having a rotating section connected to the drill string and a non-rotating section. A gap may separate the rotating section from the non-rotating section; and a flow device positioned on the drill string may flow a fluid through the gap.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

The invention claimed is:

1. A method for supplying a fluid to a wellbore tool having a bearing having an inner and an outer section, wherein an annulus is formed between the wellbore tool and a wall of a wellbore, comprising:

flowing the fluid between a first gap separating the inner and the outer section of the bearing, wherein the fluid flows from the annulus to the first gap via a second gap in the outer section of the bearing; and adding energy to the fluid using a flow device formed in the bearing due to relative rotation of the inner and the outer section.

2. The method according to claim 1, wherein the flow device is a pump.

3. The method according to claim 2, further comprising connecting a stator of the pump to a wall of a wellbore using one of: (i) a steering device having adjustable ribs, and (ii) a stabilizer having adjustable ribs.

4. The method according to claim 3, further comprising: drilling the wellbore with a drilling assembly while rotating a rotor of the pump with one of: (i) a drilling motor, and (ii) a drill string.

5. The method according to claim 2 further comprising generating a pressure differential in the fluid in the bearing by operating the pump.

6. The method according to claim 1 further comprising filtering the fluid using inserts disposed in the bearing.

7. The method according to claim 1, further comprising ejecting the fluid into the annulus.

8. An apparatus for use in a wellbore, comprising:

a drill string;

a bearing positioned along the drill string, the bearing having a inner rotating section connected to the drill string and an outer non-rotating section, wherein a first gap separates the rotating section from the non-rotating section; and an active flow device formed in the bearing, the active flow device being configured receive a fluid received from a second gap in the outer non-rotating section of the bearing and flow the fluid through the first gap and across the bearing, wherein the second gap receives the fluid from an annulus formed between the drill string and a wall of the wellbore.

9. The apparatus according to claim 8, wherein the active flow device has a stator portion fixed to the non-rotating section of the bearing and a rotor portion connected to the rotating section of the bearing, and wherein the active flow device is positioned between the rotating section and the non-rotation section.

10. The apparatus according to claim 8 wherein the bearing includes opposing ends, each end having a radially outward bearing surface and a radially inward bearing surface, the active flow device being positioned between the opposing ends, wherein one opposing end receives the fluid from the annulus and the other opposing end ejects the fluid into the annulus.

11. The apparatus according to claim 10 further comprising inserts disposed on one of: (i) the radially inward bearing surface, and (ii) the radially outward bearing surface.

12. The apparatus according to claim 11 further comprising the formation of defined gaps in between said inserts that allow passage of (i) fluid and (ii) of particles of defined size.

13. The apparatus according to claim 8 wherein the active flow device is a pump.

14. The apparatus according to claim 13 wherein the pump is a positive displacement pump.

15. The apparatus according to claim 13 wherein the pump is a hydrodynamic pump.

16. A system for use in a wellbore, comprising:

a rig disposed over the wellbore;

a drill string conveyable into the wellbore using the rig;

a bearing positioned along the drill string, the bearing having a rotating inner section connected to the drill string and a non-rotating outer section, wherein a gap separates the rotating section from the non-rotating section; and active flow device formed in the bearing, the active flow device having a gap in the non-rotating section for receiving a fluid from an annulus formed between the drill string and a wall of the wellbore and being configured to flow the fluid through the gap and across the bearing.

17. The system according to claim 16 wherein the bearing includes opposing ends, each end having a radially outward bearing surface and a radially inward bearing surface, the active flow device being positioned between the opposing ends.

* * * * *